United States Patent [19]

Okano

[11] 4,101,317

[45] Jul. 18, 1978

[54] COPPER ALLOYS WITH IMPROVED CORROSION RESISTANCE AND MACHINABILITY

[75] Inventor: Masao Okano, Suwa, Japan

[73] Assignee: Toyo Valve Co., Ltd., Tokyo, Japan

[21] Appl. No.: 761,890

[22] Filed: Jan. 24, 1977

Related U.S. Application Data

[63] Continuation-in-part of Ser. No. 399,603, Sep. 21, 1973, abandoned.

[30] Foreign Application Priority Data

Oct. 3, 1972 [JP] Japan ..... 47-99408

[51] Int. Cl.[2] ..... C22C 9/04

[52] U.S. Cl. ..... 75/156.5; 75/157.5; 148/160

[58] Field of Search ..... 75/153, 156, 156.5, 75/157.5; 148/11.5 C, 12.7, 32, 32.5, 13.2, 160; 249/135

[56] References Cited

U.S. PATENT DOCUMENTS

| | | | |
|---|---|---|---|
| 1,887,500 | 11/1932 | Crampton et al. | 75/157.5 X |
| 2,123,840 | 7/1938 | Bunn | 75/157.5 |
| 3,166,410 | 1/1965 | Hanson | 75/157.5 X |
| 3,369,893 | 2/1968 | Opie et al. | 75/157.5 |
| 3,404,977 | 10/1968 | Hopper | 75/156.5 |

*Primary Examiner*—L. Dewayne Rutledge
*Assistant Examiner*—Peter K. Skiff
*Attorney, Agent, or Firm*—Toren, McGeady and Stanger

[57] ABSTRACT

The present invention provides copper base alloys containing copper and zinc as the main components with additions of tin, lead, nickel, iron and beryllium and one of the objects of the present invention is to increase not only the corrosion resistance, but also, the machinability by defining the range of the composition as 63.0–66.0 wt.% copper, 1.2–2.0 wt.% tin, 1.0–2.0 wt.% lead, 0.1–1.0 wt.% iron, 2.0 wt.% or less of nickel, 0.1 wt.% or less of beryllium and the rest being zinc with inevitable impurities. In another aspect of the invention, the above composition is subjected to a heat treatment between about 350° and 550° C for about 1 to 10 hours after hot and cold working which produces a further significant improvement in machinability without decreasing either the corrosion resistance or the mechanical properties.

6 Claims, 30 Drawing Figures

X336

X336

X336

X336

X336

X336

X336

Corrosion Test In Hot Spring Water

Weight Decrease By Corrosion

Corrosion Test In Hot Spring Water

Dezincification Depth

Corrosion Test In Hot Spring Water
Annual Total Corrosion Depth
(Corrosion- Dezincification)

FIG. 11 No. 2 10 DAYS
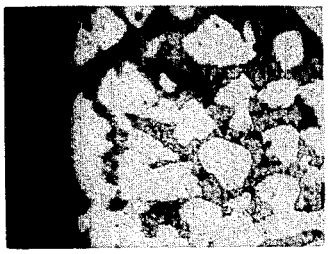
X336 DEPTH OF DEZINCIFICATION 0.12mm
FIG. 12 No. 2 21 DAYS
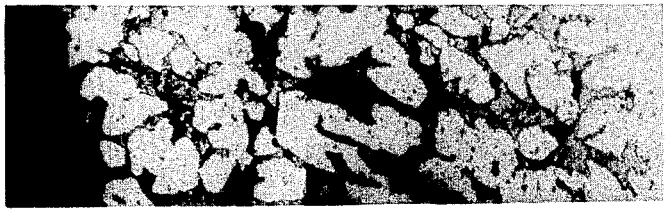
X336 DEPTH OF DEZINCIFICATION 0.25mm
FIG. 13 No. 2 32 DAYS
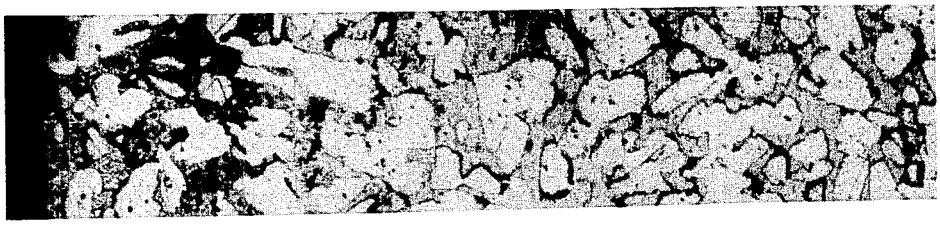
X336 DEPTH OF DEZINCIFICATION 0.39mm FIG. 14 No. 1 10 DAYS
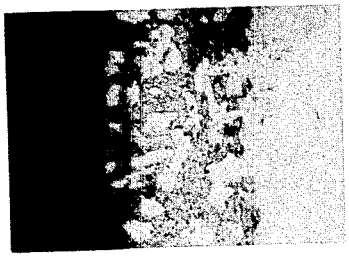
X336 DEPTH OF DEZINCIFICATION 0.07 mm
FIG. 15 No. 1 21 DAYS
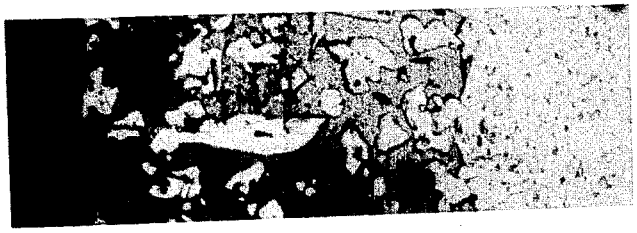
X336 DEPTH OF DEZINCIFICATION 0.16 mm
FIG. 16 No. 1 32 DAYS
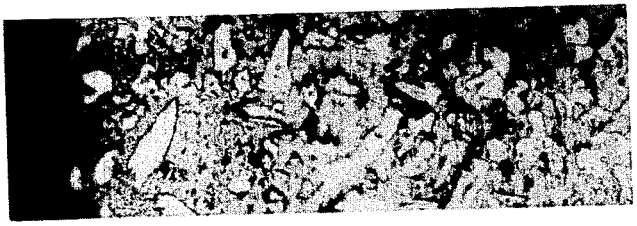
X336 DEPTH OF DEZINCIFICATION 0.24 mm FIG.17 No. 7 10 DAYS
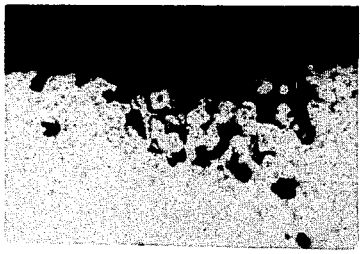
X336 DEPTH OF DEALMINIFICATION 0.04mm
FIG.18 No. 7 21 DAYS
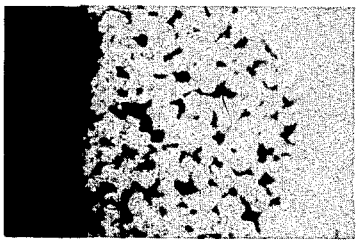
X336 DEPTH OF DEALMINIFICATION 0.09mm
FIG.19 No. 7 32 DAYS
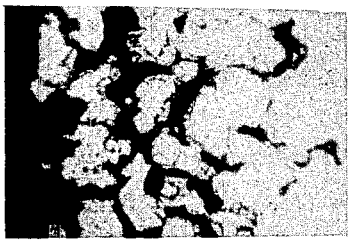
X336 DEPTH OF DEALMINIFICATION 0.13mm FIG. 20 INVENTION ALLOY 10 DAYS
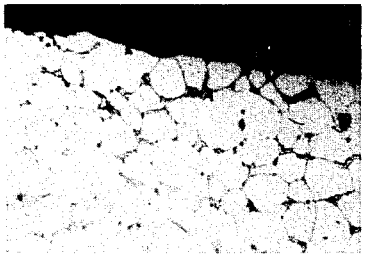
X336 NO DEZINCIFICATION
FIG. 21 INVENTION ALLOY 21 DAYS
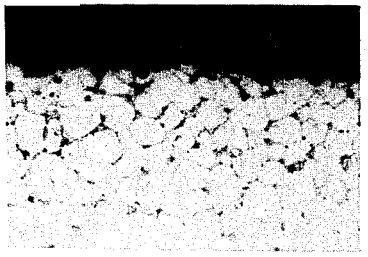
X336 NO DEZINCIFICATION
FIG. 22 INVENTION ALLOY 32 DAYS
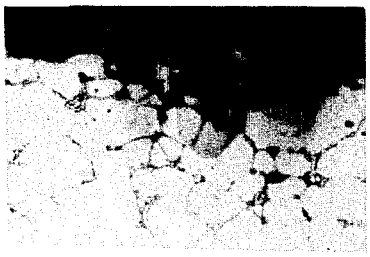
X336 DEPTH OF DEZINCIFICATION 0.03mm FIG. 24
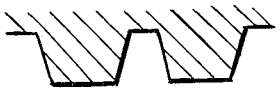
FIG. 25 No. 2 25 DAYS
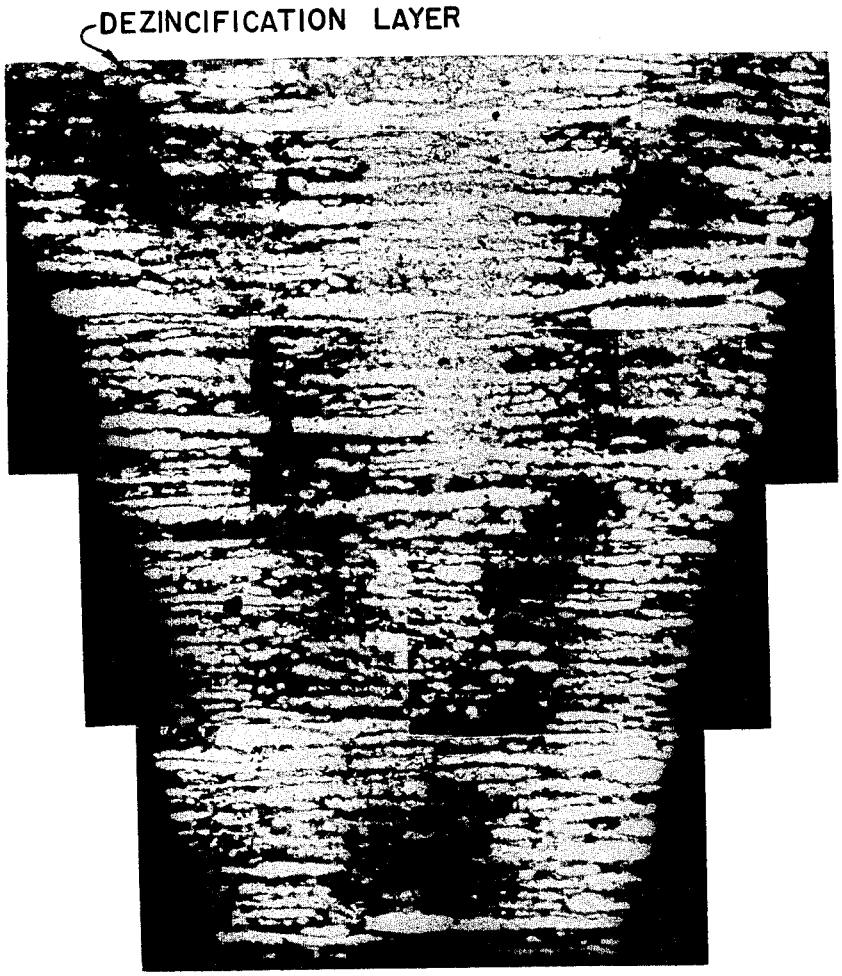
X84

FIG. 27
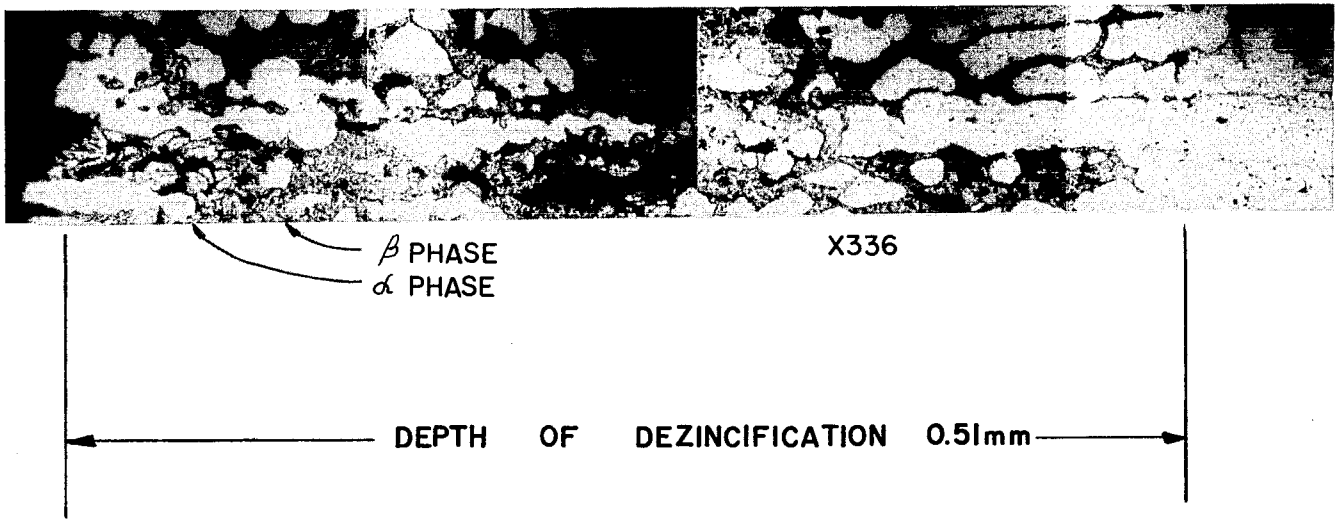
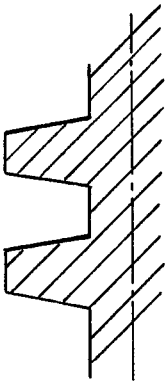
FIG. 26

FIG. 28
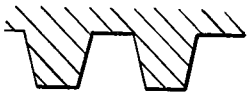
FIG. 30 INVENTION ALLOY 30 DAYS
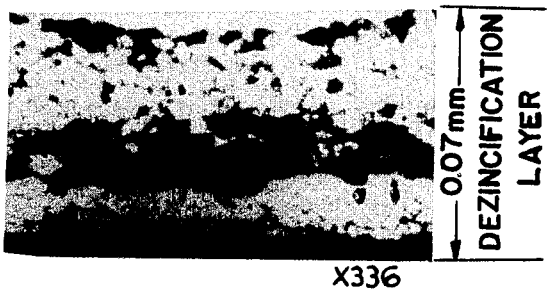
FIG. 29 INVENTION ALLOY 30 DAYS
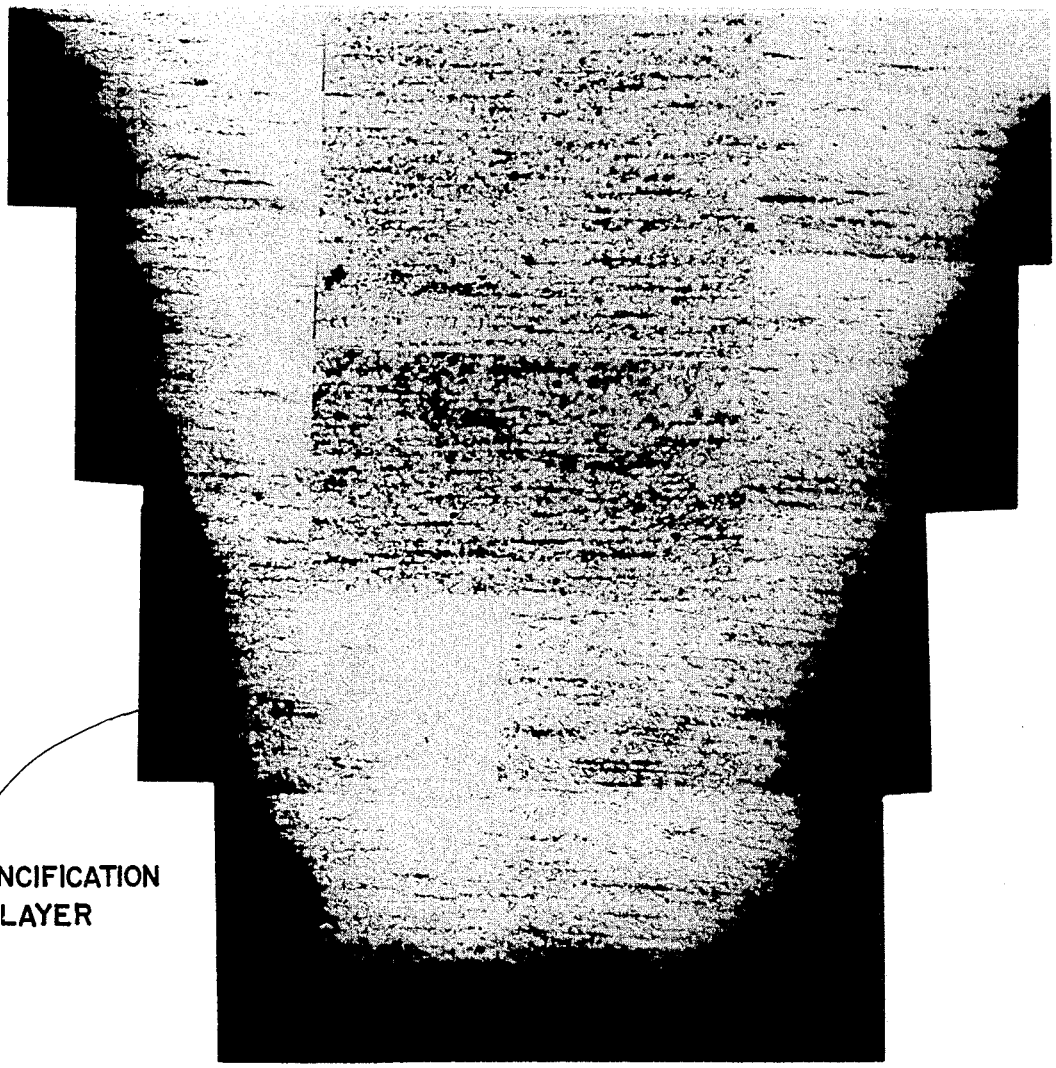

COPPER ALLOYS WITH IMPROVED CORROSION RESISTANCE AND MACHINABILITY

CROSS REFERENCE TO RELATED APPLICATIONS

This is a continuation-in-part of copending application Ser. No. 399,603, filed Sept. 21, 1973 abandoned.

BACKGROUND OF THE INVENTION

1. Field of the Invention

The present invention relates to copper base alloys with excellent corrosion resistance and machinability, containing copper and zinc as the main components, with the addition of tin, lead, nickel, iron, and beryllium.

2. Description of the Prior Art

There have been hitherto known as plastic forming copper alloys, free-cutting brass bar, forging brass bar, naval brass bar, high strength brass bar, special aluminum bronze bar, etc.. But these are not satisfactory as a material having both corrosion resistance and machinability. Particularly, free-cutting brass bar and forging brass bar with good cutting property are generally used for valve components. However, these materials, which have a high zinc content, are susceptible to dezincification corrosion in sea water or polluted water. On the other hand, it is well known, that naval brass bar, high strength brass bar and special aluminum bronze bar, which all have good corrosion resistance (against dezincification or dealuminizing corrosion), do not have good cutting properties. Further, such high strength brass bar and special aluminum bronze bar contain aluminum, silicon and manganese and are defective, in that, when used as scrap, i.e., return, for bronze castings, the elements have a bad effect on the soundness of the bronze casting.

It is also known, in the conventional processing of copper-tin alloys having an alpha plus beta phase or just having an alpha phase, after the conventional hot and/or cold rolling step, to anneal the alloy at a low temperature, i.e., between 250° and 300° C, to reduce the residual internal stress. This low temperature treatment is also effective to improve the machinability of the alloy somewhat, although a corresponding detrimental effect on the workability may also be observed.

SUMMARY OF THE INVENTION

The present invention has as an object to improve the corrosion resistance, particularly with respect to the prevention of dezincification, mechanical properties, such as, tensile strength, elongation, yield strength and cutting properties, and avoiding the above-mentioned defects of the conventional plastic forming copper base alloys.

The features of the alloys according to the present invention are:

a. as the structure is of the alpha phase is excellent, the corrosion resistance, and particularly the resistance against dezincification, is assured;
b. superior cutting properties are provided;
c. as cutting waste, they can be used as returns for bronze casting.

Specifically, the composition of the present invention comprises a copper-based, lead-containing alloy containing:

63.0 to 66 wt.% copper,
1.2 to 2.0 wt.% tin,
1.0 to 2.0 wt.% lead,
0.1 to 1.0 wt.% iron,
no more than 2.0 wt.% nickel, with the balance being zinc.

Additionally, we have further discovered that when the alloy composition of the present invention is further subjected to a heat treatment from about 350° to 550° C for a time period from about 1 to 10 hours after hot and cold working, the machinability of the alloy is greatly improved, without decreasing the workability of the composition.

BRIEF DESCRIPTION OF THE DRAWINGS

FIGS. 11 through 22 are comparative cross-sectional photomicrographs of various alloys both within and without the scope of the present invention;

FIGS. 24 and 25 are cross-sectional photomicrographs similar to those of FIGS. 11 - 22;

FIG. 28 is a cross-section diagram of a screw thread on a valve stem;

FIGS. 29 and 30 are cross-sectional photomicrographs of the valve stem of FIG. 28.

DESCRIPTION OF THE PREFERRED EMBODIMENT

Figure 1:
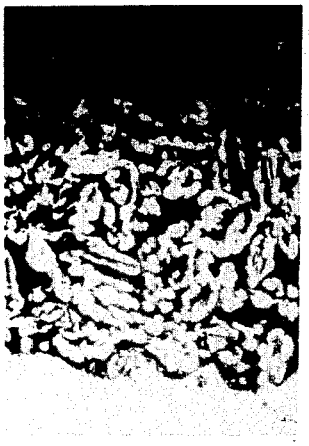
FIGS. 1, 2, 3, 4, 5, 6, and 7, are cross-sectional photomicrographs of various brass and bronze alloys.

The effects of the additional elements and the reasons of limiting the range of the composition for the alloys of the present invention are as follows:

Copper 63.0 to 66.0 wt.%

The alpha phase in brass (40% zinc, 60% copper) increases when the copper content is about 62% or more. With too much copper content, the corrosion resistance can be improved, but the tensile strength and hardness decrease. Taking into consideration the economy and the fact that dezincification takes place in the beta phase, the copper content is limited to 63.0 to 66.0 wt.%.

Tin 1.2 to 2.0 wt.%

Tin is essential and is added in order to improve the corrosion resistance. With the addition of this element, the tendency of dezincification can be significantly suppressed. It is also effective in preventing the stress corrosion cracks which occur in alpha and beta brass and also increases the mechanical properties, such as, tensile strength, and hardness. With the addition of too much tin, the alloy becomes hard and brittle. Additionally, in the present invention, when the special heat treatment as described herein is used, the tin serves to enhance the effects of this treatment.

Lead 1.0–2.0 wt.%

Lead is added in order to improve the machinability of the alloy. With an addition of less than 1% lead, sufficient machinability cannot be obtained and with more than 2%, the tensile strength, elongation, and impact strength decrease. Particularly, for plastic forming material, the addition of lead should be limited to under 2.0%.

Thus, at lead contents greater than 2.0% by weight, the improvement in the machinability with increased lead content becomes rather small and the detrimental effects of the lead with respect to the tensile properties become significant. Also, the hardness and Charpy impact value of the alloy drop sharply with increasing lead content. Particularly, it has been found that this value decreases to about one half of that without lead addition or the lead content is increased between the 2 and 3% levels.

Iron 0.1 to 1.0 wt.%

Iron has an effect of making the grains very fine. However, with too small an amount of iron, the effect is little and with more than 1%, the corrosion resistance as well as the mechanical properties, such as, the elongation and impact strength are decreased. Thus, the iron content in the alloy is limited to 0.1 to 1.0%.

Nickel 2.0 wt.% or less (lower limit 0.01 wt.%) if possible

Nickel improves the mechanical properties of the alloy. As nickel has a negative zinc equivalent, it lets the alpha phase increase. With more zinc, the beta phase increases. However, with an addition of nickel hereto, the increase of the beta phase is suppressed and an alloy with high strength and toughness can be obtained. Consequently, the trend towards dezincification, taking place in the beta phase, is suppressed. Thus, nickel is added to the alloy in order to improve the mechanical properties and corrosion resistance. However, the nickel content is limited to 2% or less in consideration of economy.

Beryllium 0.1 wt.% or less (lower limit 0.01 wt.%) if possible.

Beryllium is added in order to stabilize the alloy elements and homogenize the alloy structure. However, an amount in excess of 0.1 wt.% provides no substantial increase in effect and from an ecnonomic point of view, it is preferable to add this element in an amount of 0.1% or less.

Particularly, Be is effective as an oxidizing agent and prevents the fuming of zinc. During the melting stage, the Be produces significant deoxidation and, during this process, essentially completely disappears, although some may remain in trace amounts. Be is also advantageous since it does produce a homogeneous structure which assures a fine dispersion of lead which leads to further enhancement of the machinability.

Possible impurities appearing in the alloy are aluminum, manganese, silicon, phosphorus and sulfur. However, the total content of these materials should remain at less than 0.5 wt.%.

The alloy of the present invention can be achieved by proper combination of the elements of the above ranges, giving a copper-base alloy with excellent tensile strength, elongation, hardness, corrosion resistance and machinability. Consequently, this alloy, in view of its excellent corrosion resistance, (particularly in sea water or polluted water) and its machinability is particularly suited for use in valve components (stem, disc, etc.), machinery parts, marine equipment, electric parts, shafts, pump shafts, bushes, tube plates, etc..

The attached microscopic photographs show dezincification or dealuminization corrosion and the grain structure of examples of the alloy of the present invention and a comparative alloy.

The etching solutions used for the photographing were controlled at pH 1 and the immersion was maintained for 60 days in still water at room temperature.

Figure 2:
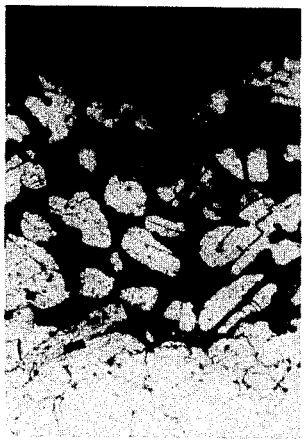
Figure 3:
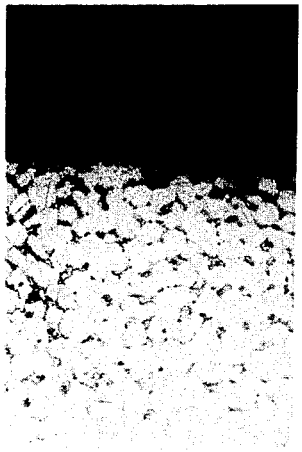
Figure 4:
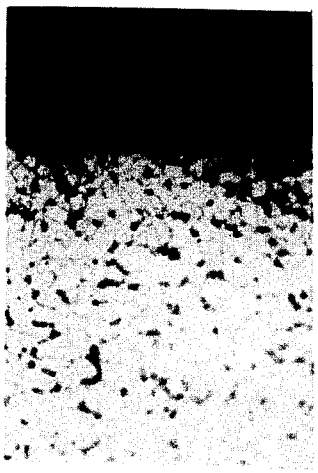
Figure 5:
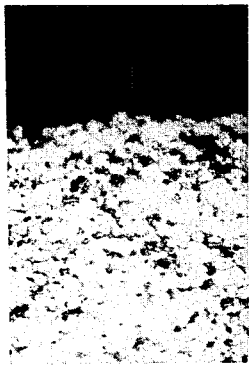
Figure 6:
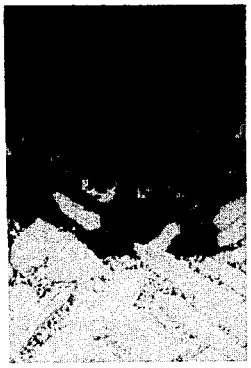
Figure 7:
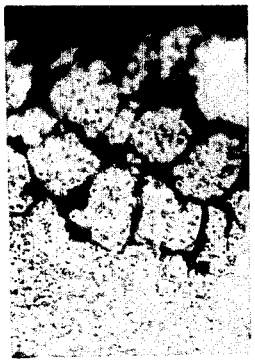

FIG. 1 is a microscopic picture of a high strength brass bar containing lead, Grade No. 2;

FIG. 2 is a microscopic photograph of a forging brass bar JIS H3423, Grade No. 2;

FIGS. 3, 4 and 5 are microscopic photographs of the alloy of the present invention;

FIG. 6 is a microscopic photograph of a naval brass bar, JIS H3424, Grade No. 2;

FIG. 7 is a microscopic photograph of a special aluminium bronze bar JIS H3441, Grade No. 2.

Figure 8:
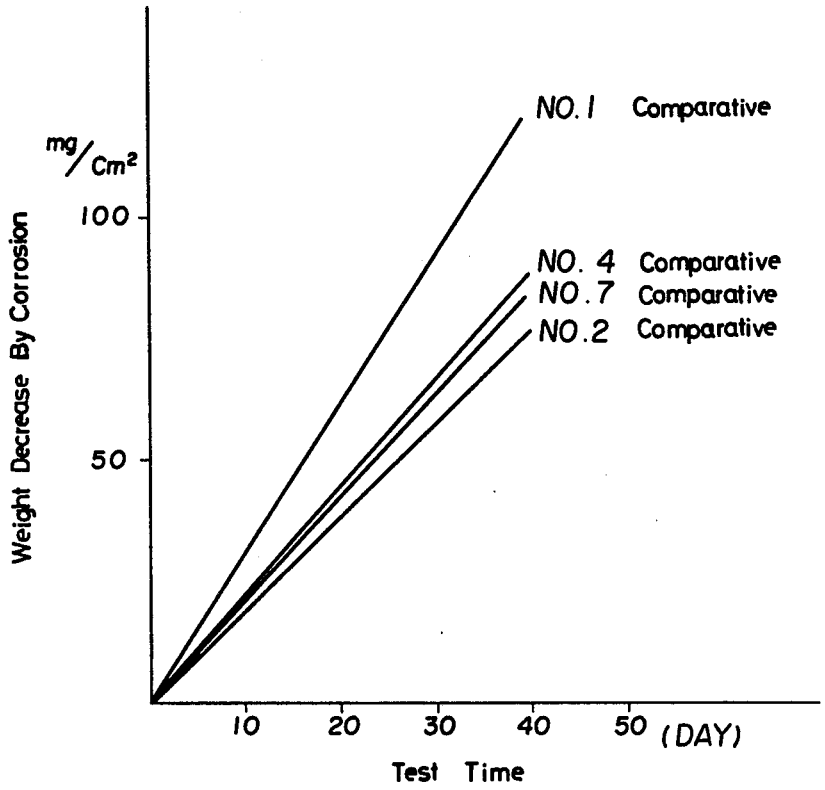
FIG. 8 is a graph of comparative corrosion tests.
Figure 9:
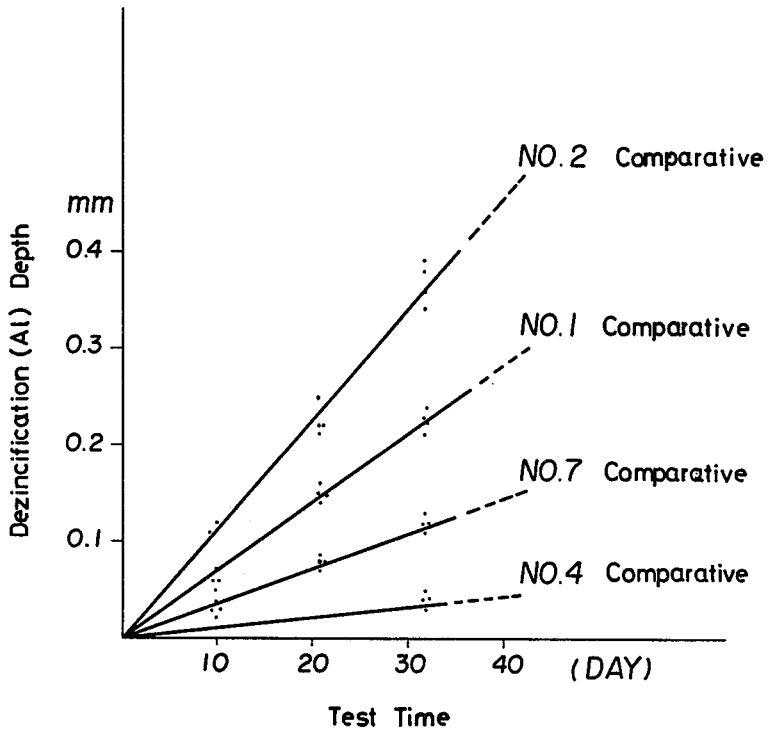
FIG. 9 is a graph of comparative dezincification tests.
Figure 10:
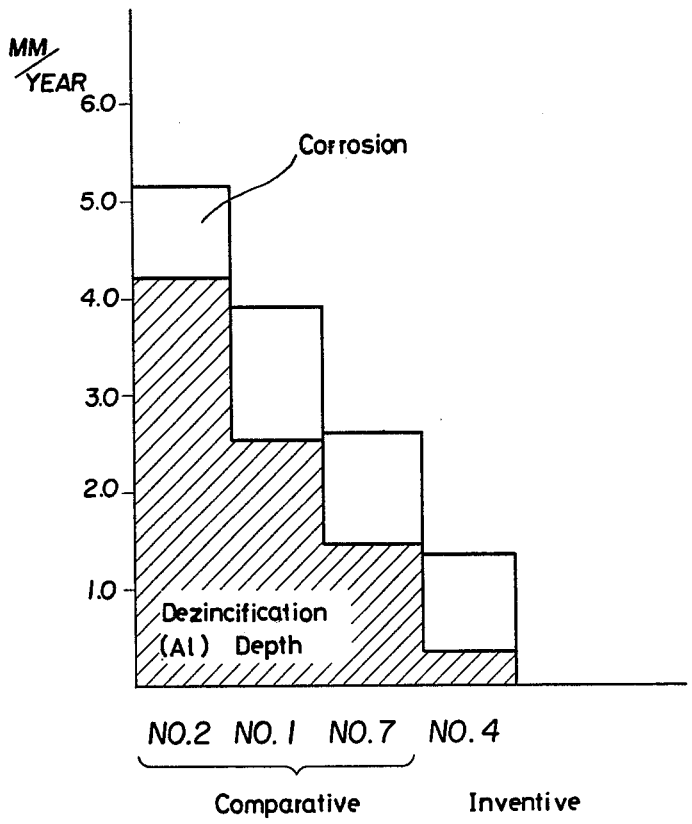
FIG. 10 is a graph of total comparative corrosion tests.

Further, FIG. 8 shows the relationship between the weight decrease by corrosion of various samples and the time period in hot spring water (in days);

FIG. 9 shows the relationship between the dezincification depth and days in the same tests;

FIG. 10 shows a total annual corrosion depth, i.e., corrosion and dezincification in the same tests.

FIG. 11 is a microscopic photograph (334 ×) showing the corrosion test results of alloy No. 2 after a test period of 10 days, from which one can see the dezincification depth of 0.12 mm.

FIG. 12 is a microscopic photograph (334 ×) showing the corrosion test results of alloy No. 2 after a test period of 21 days, the dezincification depth being 0.22 mm.

FIG. 13 is a microscopic photograph (334 ×) showing the corrosion test results of alloy No. 2 after a test period of 32 days, the dezincification depth being 0.32 mm.

FIGS. 14, 15, and 16 are microscopic photographs (334 ×) showing the corrosion test results of alloy No. 1 after a test period of 10 days, 20 days, and 32 days, respectively, the dezincification depth being 0.07 mm, 0.16 mm, and 0.24 mm, respectively.

FIGS. 17, 18 and 19 are microscopic photographs (334 ×) showing the corrosion test results of alloy No. 7 after a test period of 10 days, 21 days, and 32 days, respectively, the dealuminizing depth being 0.04 mm, 0.09 mm, and 0.13 mm, respectively.

FIGS. 20, 21 and 22 are microscopic photographs (334 ×) showing the corrosion test results of alloy No. 4 (the alloy of the present invention) after a test period of 10 days, 20 days, and 32 days, respectively; in FIGS. 20 and 21, no dezincification took place, and in FIG. 22 the dezincification depths is 0.03 mm.

Figure 23:
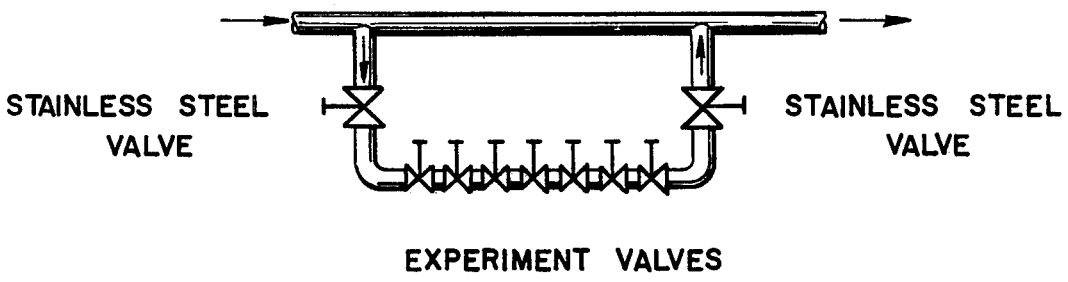
FIG. 23 is a drawing of valve bodies used in the test experiments described herein.

FIG. 23 is an explanatory sketch showing how to fix a valve body in the experiment with actual valves.

FIG. 24 is a cross-section of a screw thread on a valve stem.

FIG. 25 is a microscopic photograph (84 ×) showing the corrosion of the screw thread in FIG. 24 after a test period of 25 days of the corrosion test on alloy No. 2, the dezincification depth being 0.5–0.6 mm.

FIG. 26 is a cross-section of a screw thread on a valve stem and FIG. 27 is a microscopic photograph (334 ×) showing the dezincification of the valve stem after a test period of 25 days of the corrosion test on alloy No. 2, the dezincification depth being 0.51 mm.

FIGS. 28, 29 and 30 are, respectively, a cross-section of a screw thread of a valve stem made of No. 4 alloy (the alloy of the present invention), a microscopic photograph (336 ×) showing the corrosion (dezincification) after a test period of 30 days and an enlarged picture of the part of dezincification of the same.

Hereunder, the description will be made by means of examples in order to clarify the present invention.

TABLE 1

| No. | Chemical Composition Cu | Sn | Zn | Pb | Fe | Ni | Be | Al | Mn | | Remarks |
|---|---|---|---|---|---|---|---|---|---|---|---|
| 1 | 57.60 | 0.39 | rest | 1.20 | 0.15 | — | — | 0.68 | 0.66 | Comparative | Pb-containing high strength brass bar Grade No. 2 |
| 2 | 58.30 | 0.60 | rest | 1.42 | 0.18 | — | — | — | — | " | Forging brass bar JIS H3423 Grade No. 2 |
| 3* | 63.48 | 1.38 | rest | 1.48 | 0.16 | 0.04 | — | — | — | Inventive Example | Inventive alloy |
| 4** | 63.62 | 1.20 | rest | 1.75 | 0.39 | — | — | — | — | " | " |
| 5*** | 63.90 | 1.37 | rest | 1.33 | 0.56 | 0.03 | — | — | — | " | " |
| 6 | 60.40 | 0.80 | rest | 0.02 | 0.01 | — | — | — | — | Comparative | Naval brass bar JIS H3424 Grade No. 2 |
| 7 | 84.40 | — | — | — | 3.20 | 1.08 | — | 10.90 | 0.99 | " | Special Al-bronze bar JIS H3441 |
| 8 | 63.70 | 1.34 | rest | 1.45 | 0.43 | 0.03 | 0.02 | — | — | Inventive Example | Inventive alloy |

Note 1: The mark "—" designates "trace".
Note 2: *designates "impurity" 0.22; impurity 0.30; *impurity 0.28

Table 2

| No. | Size mm 0 | Mechanical Properties Tensile Strength (kg/mm²) | Elongation (%) | Hardness HR(B) | Drill Test (%) | Remarks |
|---|---|---|---|---|---|---|
| 1 | 12 | 70.0 | 12.0 | 84 | 57.2 | Comparative |
| 2 | 12 | 50.3 | 19.8 | 75 | 61.5 | " |
| 3 | 12 | 42.0 | 26.0 | 70 | 54 | Inventive |
| 4 | 12 | 46.5 | 23.3 | 74 | 64.8 | " |
| 5 | 12 | 47.5 | 24.0 | 77 | 57.2 | " |

EXAMPLE 1

Tables 1 and 2 show examples of the alloys of the present invention with regard to their chemical composition, tensile strength, elongation and hardness. All of the alloys are plastic forming materials and are subjected to a low temperature annealing (at about 300° C) in order to prevent season cracking. An investigation was made on test pieces for tensile strength according to JIS 14A (D = 10 mm $\phi$, GL = 50 mm), machined out of a drawn bar of 12 mm to 12.5 mm $\phi$ with the extrusion temperature of the plastic forming materials being 750° C ± 20° C.

Nos. 1, 2, 6, and 7 are comparative samples and Nos. 3, 4 and 5 are actual examples. No. 1 is a high strength brass bar containing lead, Grade No. 2, and contains aluminum and manganese, and the contents of copper and tin are less than those of the alloys of the present invention. No. 2 is a forging brass bar JIS H3423, Grade No. 2, with less copper and tin contents than the alloys of the present invention. Nos. 3, 4 and 5 are alloys of the present invention, and No. 6 is a naval brass bar JIS H3424, Grade No. 2, with less content of copper, tin and lead than those of the alloys of the present invention and No. 7 is a special aluminum bronze bar JIS H3441, Grade No. 2.

The alloys with less content of copper and tin and more content of zinc have a higher tensile strength and lower elongation. It is evident that the alloys of the present invention have, on the contrary, good elongation in spite of their relatively high content of those elements which have the effect of decreasing elongation and good cutting properties due to the content of lead.

TABLE 3

| No. | Loss in weight in 1% HCl solution mg/cm²/year | Loss in weight in HCl solution pH = 3 mg/cm²/year | Dezincification | Remarks |
|---|---|---|---|---|
| 1 | 49.820 | 34.334 | yes | Comparative |

TABLE 3-continued

| No. | Loss in weight in 1% HCl solution mg/cm²/year | Loss in weight in HCl solution pH = 3 mg/cm²/year | Dezincification | Remarks |
|---|---|---|---|---|
| 2 | 5.162 | 2.581 | yes | " |
| 3 | 0.912 | 0.782 | no | Inventive |
| 4 | 0.912 | 0.391 | no | " |
| 5 | 1.434 | 0.391 | no | " |
| 6 | — | — | yes | Comparative |
| 7 | — | — | yes* | " |

*read "de-aluminizing" instead of dezincification

Table 3 shows the result of an investigation on the alloys of the present invention and a high strength brass bar, Grade No. 2, a forging brass bar JIS H3423, Grade No. 2, using test pieces of 12 mm $\phi$ × 50 mm and a surface area of 21.1 cm², in regard to loss in weight by corrosion and dezincification in corrosive solutions. The corrosive solutions were 1% HCl solution and HCl solution adjusted to pH = 3, respectively, prepared in a 300 ml beaker, and the test was made in still water at room temperature. The loss in weight has been converted and is indicated in mg/cm²/year.

As regards No. 6 (naval brass bar JIS H3424, Grade No. 2) and No. 7 (special aluminum bronze bar JIS H3441, Grade No. 2), these were investigated only with respect to the corrosion of the surface layer and no measurement of loss in weight was made.

No. 1 relates to a high strength brass bar containing lead, Grade No. 2, and containing aluminum and manganese, with less content of copper and tin than the alloys of the present invention. This results in much loss in weight, particularly, in acidic solution and shows dezincification in 1% HCl solution and HCl solution of pH 3. As it is clear from FIG. 1, there is a large amount of beta phase, which shows clear dezincification.

No. 2 relates to a forging brass bar JIS H3434, Grade No. 2, with decreased content of copper and tin than the alloys of the present invention and shows dezincification as seen in FIG. 2.

Nos. 3, 4, and 5 relate to examples of alloys of the present invention, with decreased loss in weight in 1% HCl solution and an HCl solution of pH 3 than the comparative alloys and which also exhibit good corrosion resistance. As it is clear from FIGS. 3, 4, and 5, dezincification is not seen, the beta phase is very little and the grains are very fine.

The comparative alloys of No. 6 and No. 7, also show no dezincification nor de-aluminizing, as seen from FIGS. 6 and 7.

TABLE 4

| No. | Thickness of Dezincification layer (mm) pH 1 30 days | pH 1 60 days | pH 2 30 days | pH 2 60 days | pH 3 30 days | pH 3 60 days | Remarks |
|---|---|---|---|---|---|---|---|
| 1 | — | 0.11 | — | 0.09 | — | 0.07 | Comparative |
| 2 | 0.04 | 0.06 | 0.06 | 0.10 | 0.05 | 0.06 | " |
| 3 | no | no | no | no | no | no | Inventive |
| 4 | no | no | no | no | no | no | " |
| 5 | no | no | no | no | no | no | " |
| 6 | 0.05 | 0.07 | 0.05 | 0.06 | 0.04 | 0.06 | Comparative |
| 7 | — | 0.1 | — | 0.1 | — | 0.02 | " |

Note: For No. 7, read "de-aluminizing" for "dezincification"

Table 4 shows the test results, using test pieces of 12 mm $\phi \times 50$ mm made of the alloys of the present invention and the comparative alloys, immersed in a corrosive solution for 30 days and 60 days, respectively, and measuring the depth of the dezincification or de-aluminization layer in the microscopic structure. The pH value of corrosive solutions was adjusted to pH 1, pH 2 and pH 3, and experiments were carried out in unstirred water at room temperature.

The mark — in Table 4 means that no measurement was made.

From the above results, the excellent antidezincification properties of the alloys of the present invention are apparent.

Table 5 shows corrosion test results of the alloys of the present invention and the comparative alloys when immersed in hot spring water which is in motion.

The properties of hot spring water are as follows: Temperature: 93° C (at ambient temperature of 22.6° C) Hydrogen ion concentration (pH) 2.54 (by glass electrode pH meter) Appearance: almost colorless, clear; sour taste Components and their contents in 1 kg water.

(A) Immersion tests

TABLE 5

| No. | Corrosion Test: Corrosion rate (mg/cm²) 10 days | 21 days | 32 days | Depth of dezincification (mm) 10 days | 21 days | 32 days | Equivalent amount in annual unit (mm/year) Corrosion | Dezincification (De-aluminizing) |
|---|---|---|---|---|---|---|---|---|
| Comparative 2 | 22.82 | 41.26 | 56.42 | 0.12 | 0.22 | 0.39 | | |
| | 23.39 | 34.83 | 64.36 | 0.11 | 0.22 | 0.38 | | |
| | | | | | | | 0.95 | 4.20 |
| | 24.60 | 38.22 | 56.36 | 0.11 | 0.25 | 0.36 | | |
| | 23.74 | 32.63 | 64.34 | 0.11 | 0.21 | 0.34 | | |
| Comparative 1 | 33.85 | 79.80 | 98.96 | 0.05 | 0.14 | 0.21 | | |
| | 31.09 | 74.89 | 103.70 | 0.06 | 0.15 | 0.23 | | |
| | | | | | | | 1.37 | 2.54 |
| | 31.15 | 67.59 | 93.30 | 0.07 | 0.16 | 0.24 | | |
| | 31.26 | 69.83 | 98.50 | 0.06 | 0.15 | 0.23 | | |
| Comparative 7 | 18.79 | 41.38 | 69.77 | 0.02 | 0.07 | 0.12 | | |
| | 19.94 | 42.13 | 68.44 | 0.04 | 0.08 | 0.13 | | |
| | | | | | | | 1.18 | 1.44 |
| | 19.60 | 42.24 | 67.75 | 0.03 | 0.08 | 0.13 | | |
| | 19.77 | 40.92 | 68.38 | 0.03 | 0.09 | 0.11 | | |
| Inventive 4 | 19.08 | 42.49 | 72.72 | — | — | 0.03 | | |
| | 19.71 | 49.02 | 68.69 | — | — | 0.05 | | |
| | | | | | | | 0.98 | 0.36 |
| | 18.50 | 49.71 | 71.21 | — | — | 0.04 | | |
| | 20.80 | 46.19 | 68.09 | — | — | 0.04 | | |

TABLE 6

| Cation | (mg) | Anion | (mg) |
|---|---|---|---|
| Hydrogen ion $(H)^+$ | 1.609 | Chlorine ion $(Cl)^-$ | 769.7 |
| Calium ion $(K)^+$ | 130.8 | Fluorine ion $(F)^-$ | 1.149 |
| Sodium ion $(Na)^+$ | 587.7 | Sulfite ion $(H_2SO_3)^-$ | 301.3 |
| Calcium ion $(Ca)^{2+}$ | 70.06 | Sulfate ion $(SO_4)^{2-}$ | 528.8 |

TABLE 6-continued

| | | | |
|---|---|---|---|
| Magnesium ion $(Mg)^{2+}$ | 24.92 | Phosphite ion $(H_2PO_3)^-$ | 16.11 |
| Ferrous ion $(Fe)^{2+}$ | 0.718 | | |
| Ferric ion $(Fe)^{3+}$ | 0.306 | | |
| Manganese ion $(Mn)^{2+}$ | 0.798 | | |
| Aluminum ion $(Al)^{3+}$ | 0.629 | | |

Total 2,438 mg (cation + anion)
Boric acid 104.2 mg, Silicic acid, 101.8 mg, Arsenous acid, 2.584 mg, o-Phosphoric acid, 2.369 mg, Free carbonic acid, 171.4 mg
Grand total 2,880 mg 1. Test for corrosion loss in weight

TABLE 7

| Order | Alloy Symbol | Nomenclature | Loss in weight (mg/cm²X) 10 days | 21 days | 32 days |
|---|---|---|---|---|---|
| 1 | No. 1 | high strength brass bar including lead | 31.38 | 73.02 | 98.61 |
| 2 | No.4(alloy of the invention) | new alloy | 19.52 | 46.85 | 70.17 |
| 3 | No. 7 | aluminum bronze bar | 18.27 | 41.66 | 68.58 |
| 4 | No. 2 | forging brass bar | 23.67 | 36.71 | 60.37 |

2. Dezincification (de-aluminizing) test

TABLE 8

| Order | Alloy Symbol | Nomenclature | Depth of dezincification (de-aluminizing) mm X 10 days | 21 days | 32 days |
|---|---|---|---|---|---|
| 1 | No. 2 | forging brass bar | 0.112 | 0.225 | 0.367 |
| 2 | No. 1 | high strength brass bar including lead | 0.062 | 0.150 | 0.227 |
| 3 | No. 7 | aluminum bronze bar | 0.030 | 0.080 | 0.122 |
| 4 | No. 4 | new alloy | — | — | 0.040 |

3. Overall corrosion test

TABLE 9

| Order | Alloy Symbol | Alloy Nomenclature | Annual overall corrosion depth mm/year: Corrosion | Dezincification (de-aluminizing) | Total |
|---|---|---|---|---|---|
| 1 | No. 2 | forging brass bar | 0.95 | 4.20 | 5.15 |
| 2 | No. 1 | high strength brass bar including lead | 1.37 | 2.54 | 3.91 |
| 3 | No. 7 | aluminum bronze bar | 1.18 | 1.44 | 2.64 |
| 4 | No. 4 | new alloy | 0.98 | 0.36 | 1.34 |

4. Summary a. In regards to the dezincification, four kinds of alloys (Nos. 2, 1, 7, and 4) can be put in the following order. The ratio in the following table is established considering the depth of dezincification of the alloy of the present invention as unity. From this table, we can say that, as an antidezincification material, the alloy of the present invention, namely No. 4, is the best among these alloys.

TABLE 10

| Material | No. 2 | No. 1 | No. 7 | No. 4 |
|---|---|---|---|---|
| Annual depth mm/year | 4.20 | 2.54 | 1.44 | 0.36 |
| Ratio | 11.67 | 7.06 | 4 | 1 |

b. As regards the overall corrosion depth, the result can be given in the following table:

TABLE 11

| Material | mm/year |
|---|---|
| No. 2 | 5.15 |
| No. 1 | 3.91 |
| No. 7 | 2.62 |
| No. 4 | 1.34 |

The results of this test can be seen in FIGS. 8 through 22.

(B) Test on actual valves

The following are the results of tests on valves provided with valve stems manufactured from the test alloys.

| Location of test | Temperature | pH of fluid |
|---|---|---|
| main water feed for hot spring water | 60° C | 2.9 |

Test method

The actual valves were mounted in a by-pass line fixed on a hot spring water main, as shown in FIG. 23. Analysis of hot spring water (reported by Nagano Prefectural Hygenic Institute)

1. Results of investigation and tests at flowing point

Temperature: 90.5° C (at ambient temperature of 22.6° C)

Hydrogen ion concentration (pH): 2.8 (by calorimetry)

Nature: almost colorless, clear, exhibiting sour taste.

2. Test results in laboratory

Nature: almost colorless, clear, exhibiting sour taste.

Hydrogen ion concentration: 2.54 (by glass-electrode pH meter)

Components and their content in 1 kg test water

TABLE 12

| Cation | mg | Anion | mg |
|---|---|---|---|
| Hydrogen ion $(H)^+$ | 1.609 | Chlorine ion $(Cl)^-$ | 769.7 |
| Kalium ion $(K)^+$ | 130.8 | Fluorine ion $(F)^-$ | 1.149 |
| Sodium ion $(Na)^+$ | 587.7 | Sulfite ion $(H_2SO_3)^-$ | 301.3 |
| Calcium ion $(Ca)^{2+}$ | 70.06 | Sulfate ion $(SO_4)^{2-}$ | 528.8 |
| Magnesium ion $(Mg)^{2+}$ | 24.92 | Phosphite ion $(H_2PO_3)^-$ | 16.11 |
| Ferrous ion $(Fe)^{2+}$ | 0.718 | | |
| Ferric ion $(Fe)^{3+}$ | 0.306 | | |
| Manganese ion $(Mn)^{2+}$ | 0.798 | | |
| Aluminum ion $(Al)^{3+}$ | 0.629 | | |

Total 2,438 mg (cation + anion)

Boric acid, 104.2 mg; Silicic Acid 101.8 mg; Arsenic acid, 2.584 mg; o-Phosphoric acid, 2.369 mg; Free carbonic acid 171.4 mg Grand total 2,880 mg 1. Corrosion loss in weight test

TABLE 13

| Order | Alloy Symbol | Alloy Nomenclature | Corrosion loss in weight ($mg/cm^2X$): 10 days | 21 days | 32 days |
|---|---|---|---|---|---|
| 1 | No. 1 | high strength brass bar including lead | 31.83 | 73.02 | 98.61 |
| 2 | No. 4 | present invention | 19.52 | 46.85 | 70.17 |
| 3 | No. 7 | aluminum bronze bar | 18.27 | 41.66 | 68.58 |
| 4 | No. 2 | forging brass bar | 23.67 | 36.71 | 60.37 |

2. Dezincification (or de-aluminizing) test

TABLE 14

| Order | Alloy Symbol | Alloy Nomenclature, | Depth of dezincification (dealuminizing) mm X: 10 days | 21 days | 32 days |
|---|---|---|---|---|---|
| 1 | No. 2 | forging brass bar | 0.112 | 0.225 | 0.367 |
| 2 | No. 1 | high strength brass bar including lead | 0.062 | 0.150 | 0.227 |
| 3 | No. 7 | aluminum bronze bar | 0.030 | 0.080 | 0.122 |
| 4 | No. 4 | present invention | — | — | 0.0402 |

3. Overall corrosion test

TABLE 15

| Order | Alloy Symbol | Alloy Nomenclature | Depth of annual overall corrosion mm/year: Corrosion | Dezincification (de-aluminization | Total |
|---|---|---|---|---|---|
| 1 | No. 2 | forging brass bar | 0.95 | 4.20 | 5.15 |
| 2 | No. 1 | high strength brass bar including lead | 1.37 | 2.54 | 3.91 |
| 3 | No. 7 | aluminum bronze bar | 1.18 | 1.44 | 2.64 |
| 4 | No. 4 | present invention | 0.98 | 0.36 | 1.34 |

4. Summary a. Test with actual valves

The results of tests performed with valve stems made of $B_sBF$ (forging brass bar) and the alloy of the present invention show a depth of dezincification of 0.5–0.6 mm in 25 days for $B_sBF$, and the thread is almost completely destroyed due to dezincification. The strength is significantly reduced and the break-off of the thread is only a matter of time since this break-off would vary depending on usage. The alloy of the present invention, in 30 days shows dezincification of 0.05–0.07 mm on only some parts of the thread. It is assumed that there is little decrease in strength since the depth of dezincification is small. The above-mentioned test results can be seen in FIG. 23 through FIG. 30.

An experiment was carried out using several identical alloy samples having a composition within the scope of the present invention. The samples were subjected to the above-described conventional heat treatment and the heat treatment in accordance with the present invention. The treatment conditions and properties of the treated samples are shown in Table 16.

TABLE 16

| | Cutting Resistance (kg) | Tensile Strength (kg/mm$^2$) | Elongation (%) |
|---|---|---|---|
| Heat Treatment as defined above | | | |
| 1. 400° C for 1 hour after 5% working | 28.5 | 48 | 30 |
| 2. 500° C for 1 hour after 5% working | 29.0 | 47.5 | 35 |
| Conventional Heat Treatment | | | |
| 1. at 270° C for 1 hour after casting | 36.0 | 39 | 20 |
| 2. at 800° C for 1 hour after casting | 36.5 | 41 | 26 |

Thus, it is clear that with the heat treatment of the present invention, the machinability of the alloy can be unexpectedly further improved by about 20 percent as compared to the conventional low temperature treatment.

What is claimed is:

1. Copper-base alloy having improved corrosion resistance and machinability, consisting essentially of 63.0–66.0 wt. % copper,
1.2–2.0 wt. % tin,
1.0–2.0 wt. % lead,
0.1–1.0 wt. % iron,
2.0 wt. % or less nickel,
0.1 wt. % or less beryllium, with the balance being zinc and unavoidable impurities, said alloy having been subjected to conventional hot and cold working and thereafter subjected to a heat treatment in the range from about 350 to 550° C for about 1 to 10 hours.

2. The alloy of claim 1 wherein the beryllium content is in the range from 0.01% by weight to 0.1% by weight.

3. Copper-base alloy having improved corrosion resistance and machinability, consisting essentially of 63.0–66.0 wt. % copper,
1.2–2.0 wt. % tin,
1.0–2.0 wt. % lead,
0.1–1.0 wt. % iron,
2.0 wt. % or less nickel, with the balance being zinc and unavoidable impurities, said alloy having been subjected to conventional hot and cold working and thereafter subjected to a heat treatment in the range from about 350° to 550° C for about 1 to 10 hours.

4. A malleable bar consisting of the alloy of claim 3.

5. The bar of claim 4 which has been subjected to low temperature annealing to prevent season cracks.

6. A method for improving the machinability of a corrosion resistant copper based alloy comprising, subjecting an alloy consisting essentially of 63.0–66.0 wt. % copper,
1.2–2.0 wt. % tin,
1.0–2.0 wt. % lead,
0.1–1.0 wt. % iron,
2.0 wt. % or less nickel with the balance being zinc and unavoidable impurities to conventional hot and cold working and then to a heat treatment in the range from about 350° to 550° C for about 1 to 10 hours.

* * * * *